United States Patent [19]

Esteve et al.

[11] Patent Number: 4,670,016

[45] Date of Patent: Jun. 2, 1987

[54] METHOD AND UNIT FOR TREATMENT OF SKINS WITH A VIEW TO SEPARATING THE WOOL FROM THEM, AND CONSTITUENT MEANS

[75] Inventors: Gerard Esteve; Jean Amalric, both of Mazamet, France

[73] Assignees: S.A. des ETS Marceau AMALRIC; LA MOLE Industries, S.A., both of Mazamet, France

[21] Appl. No.: 661,720

[22] Filed: Oct. 17, 1984

[30] Foreign Application Priority Data

Oct. 18, 1983 [FR] France ..... 83 16845

[51] Int. Cl.[4] ..... C14C 1/06

[52] U.S. Cl. ..... 8/94.16

[58] Field of Search ..... 8/94.16

[56] References Cited

U.S. PATENT DOCUMENTS 48,578 7/1865 Miller et al. ..... 8/94.16
519,345 5/1894 Puech ..... 8/94.16
2,346,907 4/1944 Christopher ..... 8/94.16
3,582,254 6/1971 Lindemann ..... 8/94.16

*Primary Examiner*—A. Lionel Clingman
*Assistant Examiner*—John F. McNally
*Attorney, Agent, or Firm*—Harold H. Dutton, Jr.

[57] ABSTRACT

The invention is concerned with a method and a unit for treatment of skins with a view to separating the wool from them. This method consists in combining the following operations: (a) steeping the skins in a waterbath in vertical or sloping stacks (M); (b) carrying out a picking 8 upon the hair side of the skins; (c) carrying out a fleshing 10 upon the flesh side of the skins; (d) impregnating the flesh side of the skins by means of an aqueous solution of sulphide (11); (e) arranging the skins separately from one another in an atmosphere saturated with moisture at a temperature lying between 20° and 25° for a period of time lying between 2 and 5 hours (12); (f) carrying out a wool-stripping operation (31) for separating the wool from the skins; and (g) immediately rinsing the wool so separated (34–37).

12 Claims, 13 Drawing Figures

METHOD AND UNIT FOR TREATMENT OF SKINS WITH A VIEW TO SEPARATING THE WOOL FROM THEM, AND CONSTITUENT MEANS

The invention is concerned with a method of treatment of sheepskins (or other near species) with a view to separating the wool from them; it extends to a treatment unit intended for implementing this method, as well as to new means constituting this unit.

BACKGROUND AND OBJECTS OF THE INVENTION

Fellmongering industries have as their objective the treatment of skins in order to produce on the one hand bare skins (sometimes designated by "pelts") intended for the manufacture of leathers by tawery, and on the other hand the wool which is called upon to undergo various treatments up to spinning.

Two essential types of method are at present employed in these fellmongering industries; these methods consist in a first phase in preparing the skins by steeping and picking operations and then in a second phase in ensuring an attack upon the roots of the hairs of the wool with a view to weakening their resistance and finally in a last phase, in carrying out the operation proper of stripping the wool from the skins (still designated by "unhairing"), which consists in tearing the hair from the skin.

The preparatory operations common to the two methods comprise a first steeping which is put into effect by stacking the skins upon one another and immersing these stacks in steeping tanks and then a picking operation intended for removing the impurities contained in the wool, and finally a second steeping similar to the first. These operations last about 48 hours.

In one of the methods, the older one, the second phase is carried out by a process of bacteriological fermentation the average duration of which is of the order of 4 days. Under these conditions, taking into account operations of preparation, the duration of a wool-stripping cycle in this type of method is of the order of one week and this duration is one of the essential disadvantages of this method.

In the other method the second phase consists in impregnating the flesh side of the skins by means of a solution having a base of sodium sulphide, and in stacking the skins on pallets and leaving them to stand like that for about 8 to 12 hours in order to allow diffusion of the sulphide through to the hair side. This method with sulphide thus offers the advantage of considerably shortening the duration of the wool-stripping cycle.

However, the sulphide method as employed at present has a number of serious disadvantages. In the first place the complete cycle which lasts about 60 hours remains long and it would be highly desirable to shorten it in order to make more profitable use of the materials and to reduce the necessary storage areas; in addition the quality of the skins and the wools obtained is generally mediocre and very uneven from one skin to another. That is, during the course of the skins' standing in the form of a stack on the pallets the wool inevitably becomes soiled by the sulphide which causes a more or less marked degradation of it; again, the skins situated on top of each stack are subjected to a sulphide action of shorter duration than the skins situated below; that is, the skins on the top are the last to be put into place on the stack and the first to be removed. As a consequence these skins (known as white skins) are difficult to strip of their wool because of a too superficial action of the sulphide, whereas the skins below (known as black skins) have undergone too powerful an attack, bringing with it risks of degradation of the wool and a blackening of certain zones of them which then lowers the quality of the leathers manufactured from them.

The present invention proposes to indicate a method of treatment employing sulphide like the known method but exempt from the aforesaid defects of this method.

It is aimed essentially at indicating a method the duration of implementation of which is considerably shortened and which enables skins and wools to be produced which profit by a good quality which is uniform for all of the skins.

Another objective of the invention is to reduce the personnel necessary for a given production whilst making the work much less arduous for the labour force.

Another objective is to provide a treatment unit which enables implementation of the said method under the most profitable conditions.

DESCRIPTION OF THE INVENTION

For this purpose the method of treatment in accordance with the invention consists in combining the following operations in succession:

(a) Steeping the skins in a bath of water which is renewed several times, the skins being arranged in a vertical or sloping stack so that each skin displays a position which is vertical or inclined with respect to the horizontal;

(b) Carrying out upon the hair side of the skins a picking known in itself, suitable for disencumbering them of the impurities contained in the wool;

(c) Carrying out upon the flesh side of the skins a fleshing known in itself, suitable for disencumbering them of fragments of flesh and fat;

(d) Impregnating the flesh side of the skins by means of an aqueous solution of sulphide in a concentration lying substantially between 100 g/l and 300 g/l;

(e) Arranging the skins separately from one another in an atmosphere saturated with moisture at a temperature lying substantially between 20° and 35° C. for a period of time lying substantially between 2 hours and 5 hours;

(f) Carrying out upon the skins a wool-stripping operation known in itself, suitable for separating the wool from them; and (g) Immediately rinsing the wool so separated so as to eliminate from it the traces of sulphide.

Hence the method of the invention differs essentially from the former method previously quoted:

By the mode of implementation of the steeping operation (a);

By carrying out a fleshing operation (c) (known in itself in tawery) before the sulphide treatment;

By the nature of the operation (e) during which the diffusion of the sulphide is effected from the flesh side through to the hair side with a view to ensuring an attack upon the roots of the hairs of the wool;

By carrying out an immediate rinsing of the wool after the wool-stripping operation.

As will be understood better later, the combination of these original characteristics leads at one and the same time to a significant reduction in the duration of the wool-stripping cycles (a duration less than 36 hours)

and to a very much improved and constant quality, both of the skins and of the wools produced.

The steeping operation (a) may advantageously be put into effect by stacking the skins flat in perforated cages, causing each of the said cages to pivot about itself with a view to giving the stack a vertical or sloping position, arranging the said cages in at least one steeping-tank, feeding the latter with rinsing water and renewing this water several times.

Such steeping has proved extremely effective, this being in spite of a duration which may be limited to 24 hours and without having recourse to wetting agents (which are generally employed in the known methods); the skins arranged in vertical (or inclined) positions define between them vertical or inclined spaces which are traversed by thin trickles of water during the course of draining and the intense circulation thus generated between the skins causes much more rapid saturation of them and very effective carrying away of deposits. Thus a high-quality softening is obtained in only one steeping stage, the duration of which may be of the order of half of that which the steepings require in the known methods.

In particular the steeping operation (a) may comprise between 2 and 4 renewals of the water and last approximately 24 hours. Preferably new cured skins will be employed (and not dried skins).

The picking operation (b) is an operation well known in itself in the fellmongering industries and is put into effect continuously in a traditional manner.

The addition of a fleshing operation (c) is new in wool-stripping methods. In fact this operation which consists in disencumbering the flesh side of fragments of fats and flesh is practised solely in tawery upon pelts, once they have been stripped of their wool; in itself the implementation of this operation is conducted as in tawery. It has been possible to take into account that it did not bring about any deterioration of the wool on the hair side, and that its presence was essential for the obtaining of the final result at the end of the cycle; in fact it provides a skin of uniform thickness the surface state of which on the flesh side is homogeneous; these qualities then contribute to speeding up the diffusion of the sulphide towards the hair side and to ensuring a homogeneity of treatment of all zones of the skin.

The impregnation operation (d) may be effected in a manner in itself known, by arranging each skin with its flesh side situated uppermost and by scattering the sulphide solution in the form of fine drops over the skin.

The operation (e) is one of the essential originalities of the method of the invention and makes a big contribution to the obtaining of skins and wool of good quality; it likewise enables the cycle of production to be shortened, its average duration being of the order of 3 hours (instead of about 10 hours for the similar operation of the conventional method). This operation (e) is essentially characterized in that on the one hand the skins are treated individually by separating them from one another and in that on the other hand they are arranged in a specific atmosphere suited to favouring rapid and uniform diffusion of the sulphide, this being during a time which is identical for each skin, corresponding with the time necessary for the diffusion and for the attack upon the roots of the hairs without blackening the hair side or degradation of the wool.

In accordance with a preferred mode of implementation, this operation (e) is effected by introducing the skins into a tunnel containing a saturated atmosphere heated to a temperature of the order of 25° to 30° C., causing each of the said skins to travel inside the said tunnel between an entrance to and an exit from it and discharging each skin at the end of its travel through the said tunnel.

The conditions of temperature and hygrometry may be ensured by water vapour being injected along the tunnel in several zones of it under conditions suitable for heating the skins in the vicinity of the entrance up to the appropriate temperature and for then keeping the skins at the said temperature until in the vicinity of the exit.

The wool-stripping operation (f) is performed as soon as the skins leave the aforesaid tunnel; its implementation is in itself conventional.

Finally the operation (g) of rinsing the wool which immediately follows the wool-stripping operation avoids the wool remaining in contact with traces of sulphide, the action of degradation caused by this substance being very rapid.

This rinsing operation may in particular be effected in at least two rinsingtanks at least one of which contains a waterbath to which oxygenated water has been added. One thus obtains a radical elimination of any trace of sulphide, which then enables the wool to be preserved in a good state.

The invention extends to a treatment unit which enables the implementation of the method defined above; this unit comprises on the one hand steeping means suitable for enabling the skins to be steeped in positions which are vertical or inclined with respect to the vertical, and on the other hand a sequence of treatment after steeping; this sequence includes the followiong means arranged at successive stations:

Picking means;

Fleshing means;

Means of scattering a sulphide solution;

A tunnel of elongated shape, equipped with means of conditioning the atmosphere inside it and means of travel of the skins between an entrance situated in the vicinity of one end of the tunnel and an exit situated in the vicinity of its other end;

Means of stripping the wool; and

Means of rinsing the wool, suitable for the elimination of the traces of sulphide.

In accordance with a preferred embodiment, the means of travel with which the aforesaid tunnel is equipped comprise essentially:

Two sidechains opposite one another, guided in order to form two superimposed horizontal sections, one rising section and one descending section;

A plurality of crossbars articulated like swings between the two chains so as to keep one and the same orientation along all the sections;

Means of sequential driving of the said chains.

The invention extends to a tunnel, considered as such, which possesses the characteristics described above and which will be described later, with a view to favouring the diffusion of a liquid product in the heart of the skins.

DESCRIPTION OF THE DRAWINGS

Other characteristics, aims and advantages of the method and of the treatment unit in acordance with the invention will be revealed in the description which follows with reference to the attached drawings which are given by way of nonrestrictive example; in these drawings which form an integral part of the present description.

DESCRIPTION OF THE PREFERRED EMBODIMENTS

The unit represented by way of example in the Figures enables the stripping of wool from skins to be effected by a cycle of treatment of duration less than 1.5 days. Preferably the treatment is carried out upon new skins. The unit consists upstream of means M of steeping the skins and after steeping of a continuous sequence of treatment T.

Figure 1:
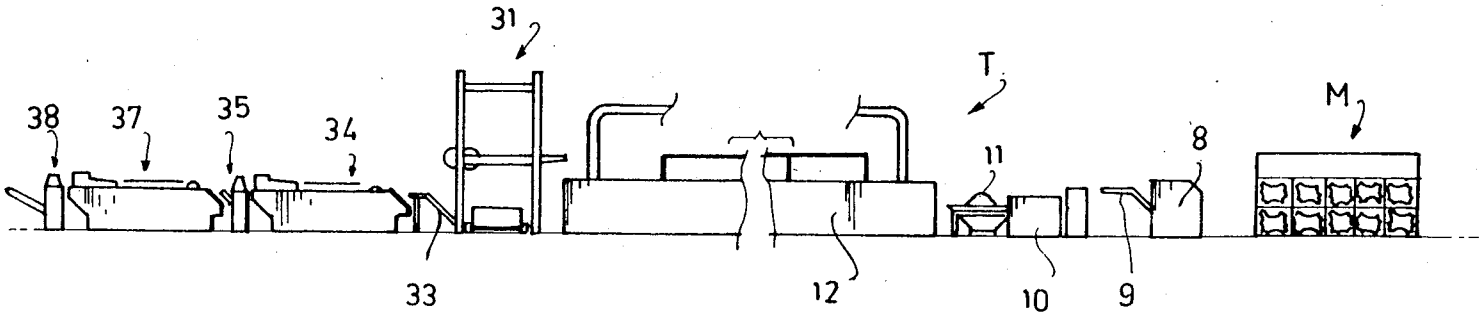
FIG. 1 is a diagram showing symbolically the treatment unit which is essentially composed of steeping means M and of a sequence T of treatment after steeping which has been divided up into several sections A, B, C, D (the arrows indicating the direction of travel of the products)
Figure 2:
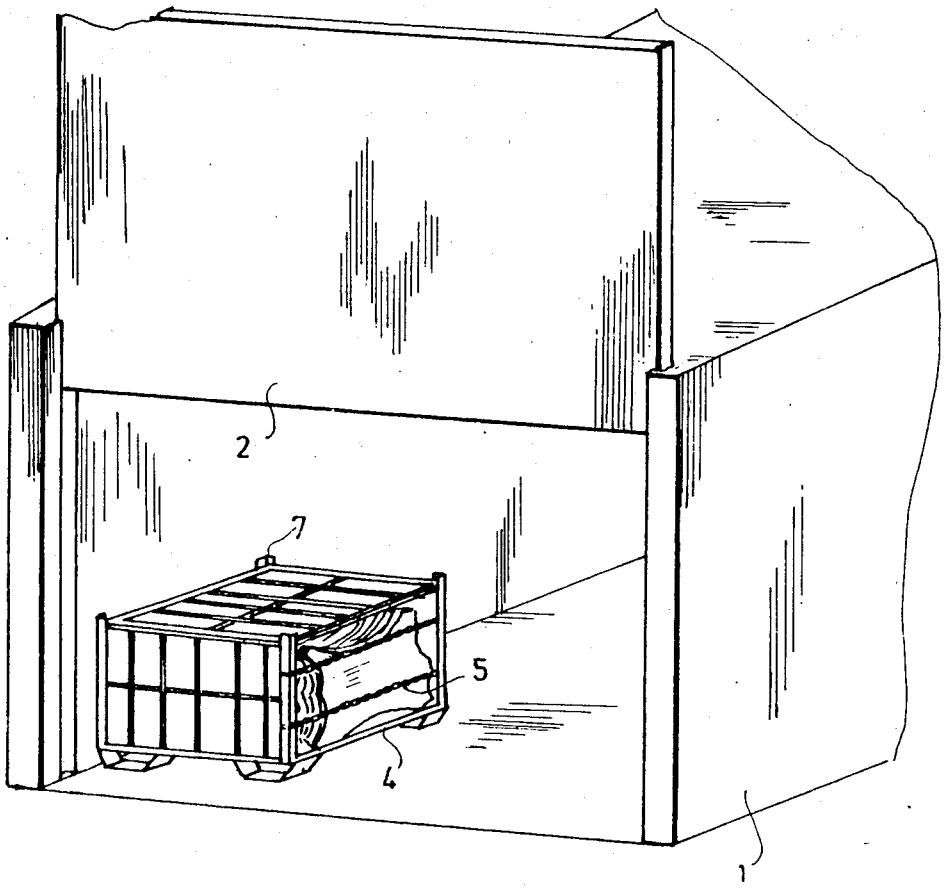
FIG. 2 is a diagrammatic figure showing the steeping means M.
Figure 2:
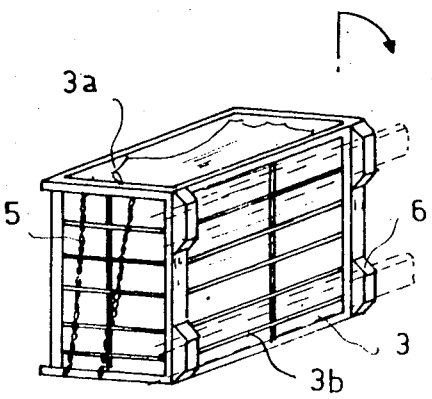

The steeping means comprise steeping tanks such as the tank 1 shown diagrammatically in FIG. 2. This tank is endowed at the front with a watertight door 2, means of feeding with water of conventional type (water pipes of suitable capacity) and means of drainage of conventional type (plug provided in the horizontal bottom face). Such tanks known in themselves in the fellmongering industry enable filling and discharge in about twenty minutes.

The skins for steeping are arranged in a number of perforated cages such as 3 or 4; each cage of rectangular parallelepipedal shape has an open face 3*a* of dimensions suitable for introducing one skin flat as represented in FIG. 2. Each cage can contain a stack of about 130 skins.

For loading, the cages are arranged standing on the ground on the face opposite to the open face and the skins are positioned flat in horizontal planes.

Each cage includes a member for shutting off its open face, in the example small chains 5, and at the end of loading these are hooked so as to lock the stack and immobilize the skins.

Upon one face 3*b* adjacent to the open face 3*a*, each cage comprises means of seizing it which enable it to be raised and turned with the aid of a conventional rotary lifting machine. In the example four hollow blocks such as 6 are fastened externally onto the cage in order to enable a machine fork to be passed through (the ends of this may be seen in broken line in FIG. 2).

The cage may thus be raised and caused to pivot through 90° so as to come to rest in the tank 1 on the blocks 6 on the face 3*b*, which serve the purpose of supporting blocks. The skins thus come to be arranged vertically as illustrated for the cage 4 in FIG. 2.

The tank 1 can contain several levels of cages thanks to guide lugs 7 which enable them to be superimposed. For example, the dimensions of a tank may be adapted for containing 10 cages on two levels.

Once the cages have been introduced into the tank the door 2 of it is closed and the tank is filled with water. The skins are left for about 24 hours in it, three renewals of the water being effected.

At the end of this operation it can be confirmed that the skins are perfectly impregnated up to saturation, the surface deposits having been eliminated.

The skins are then extracted from the tank and conveyed towards the treatment sequence T. Of course as far as possible the steeping means M will be situated in the vicinity of the upstream portion of the sequence T (with the necessary handling areas) in order to shorten transfers.

The treatment sequence T is composed of several units arranged one after another in order to enable continuous treatment of the skins.

Figure 3A:
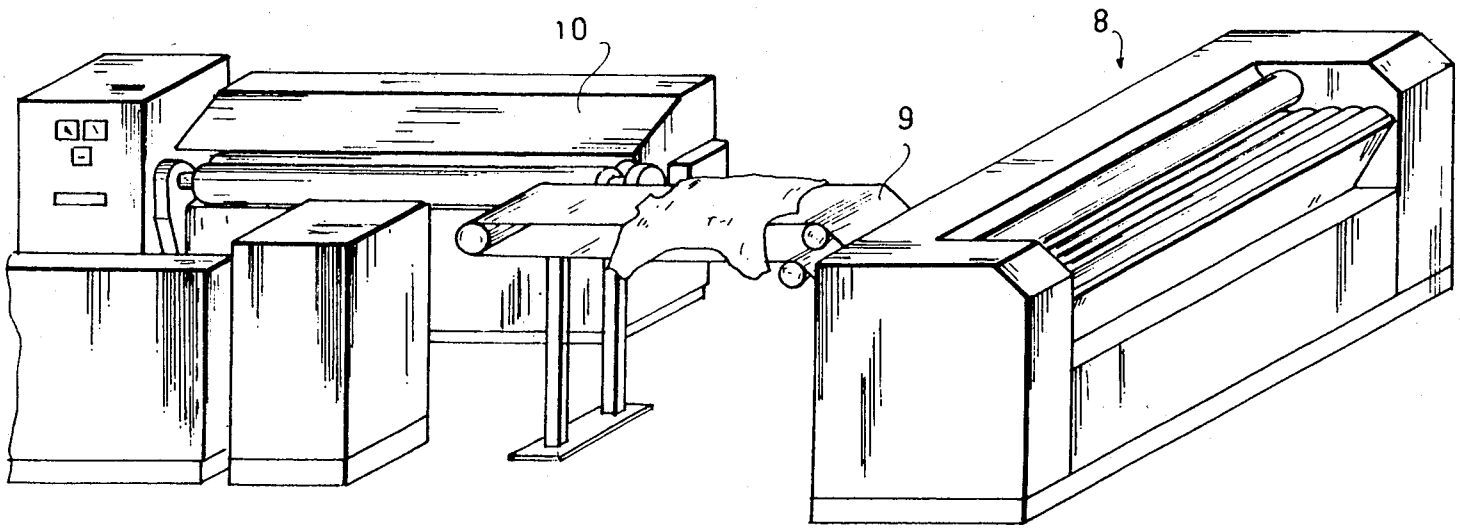
FIG. 3A is a diagrammatic figure of section A of the treatment sequence T.

In the upstream portion (FIG. 3A) this sequence comprises a picker 8 of a type in itself known, which disencumbers the wool of the impurities which it may contain.

Upon leaving the picker the skins are taken up again by a conveyor belt 9 the width of which is less than that of the skins; they are thus arranged in a position suited to facilitating the cutting off of the feet at the level of this belt.

This belt then carries the skins towards a flesher 10 of a type in itself known in tawery. This machine which works on the flesh side disencumbers the skins of the fragments of flesh and fats which are adhering to them and provide a skin of uniform thickness having a homogeneous state of the surface on the flesh side.

Figure 3B:
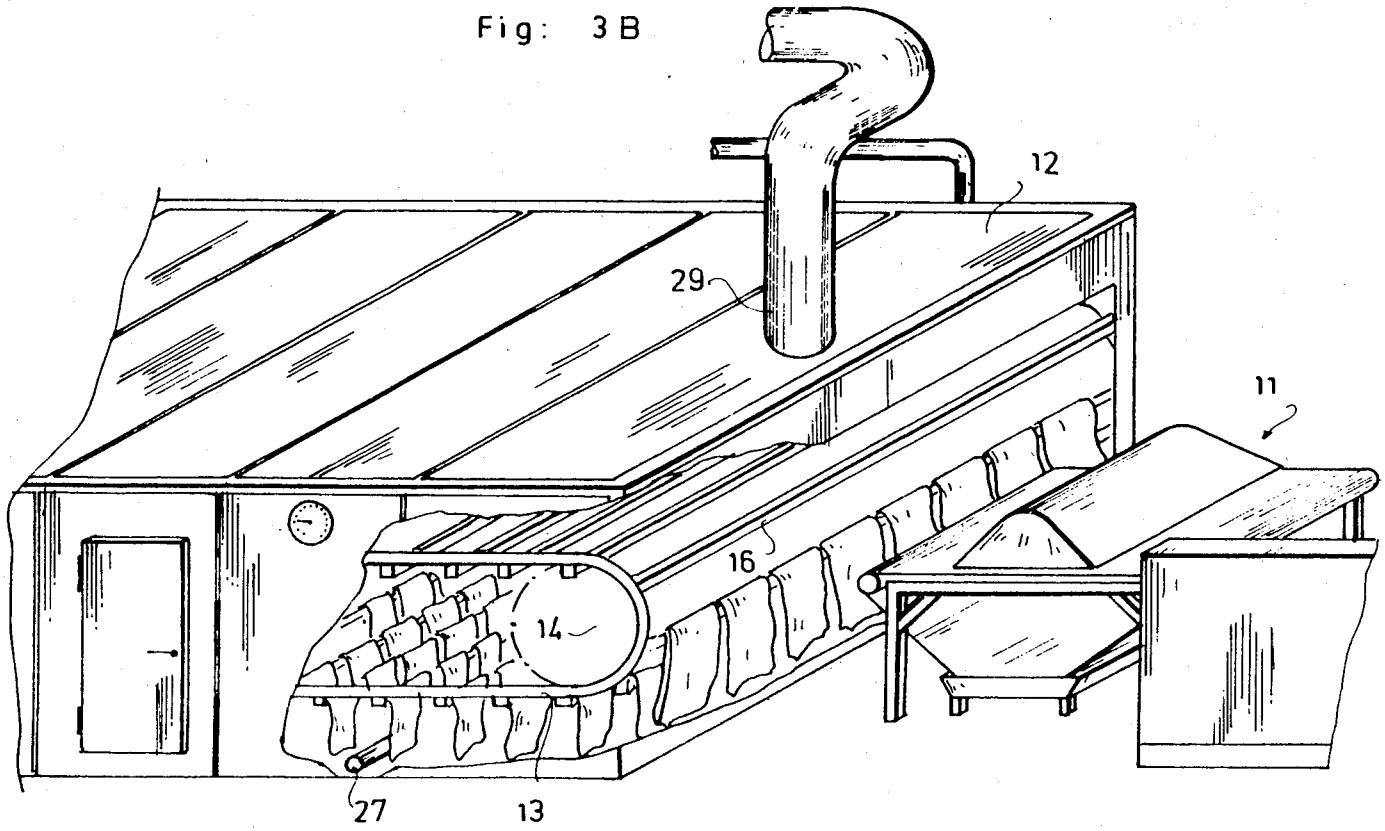
FIG. 3B is a diagrammatic figure (of section) B of the sequence T.

At the outlet from the flesher 10 (FIG. 3B) the skins are arranged on a machine 11 for impregnation with sulphide (generally designated by "limer"). This machine which is in itself known, includes a row of sprays which enables a solution having a sulphide base to be scattered over the flesh side of each skin; for this purpose the skin is arranged on a belt consisting of parallel cords with its flesh side directed upwards, and passes below the row of sprays.

The solution employed is an aqueous solution containing a concentration of sodium sulphide approximately equal to 200 g/l; a percentage of lime may be added to this solution for improving the adhesion of the sulphide onto the skin.

The skins thus impregnated one by one are taken up individually by an operator in order to be introduced into a tunnel 12 with a view to the diffusion of the sulphide.

This tunnel consists of a closed cell of elongated rectangular parallelepipedal shape, the length of which is in particular of the order of 40 to 45 m. It is open on the one hand at its upstream end in order to form an entrance for the introduction and the putting in place of the skins, and on the other hand at its downstream end in order to form an opposite exit for the withdrawal of the said skins after passing through the tunnel.

Figure 5:
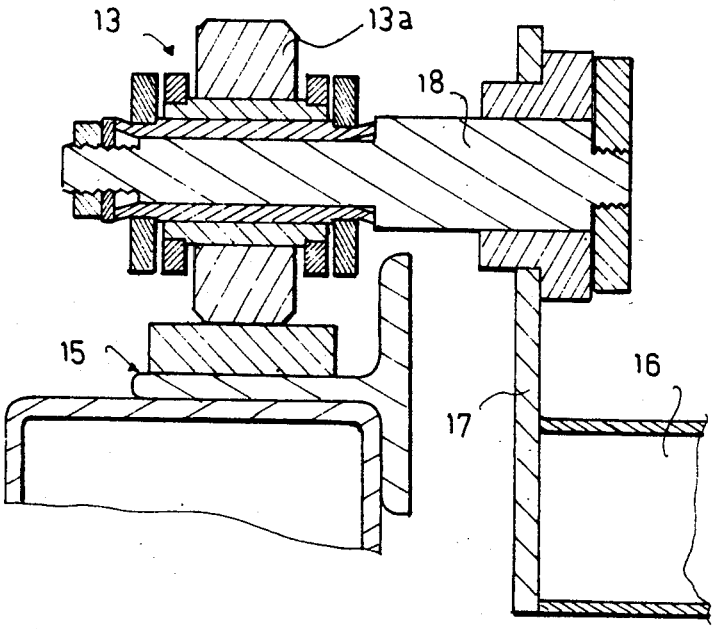
FIGS. 5, 6 and 7 are details of members of this unit.

The tunnel 12 comprises in the vicinity of its long sides two endless roller chains such as 13 which are each guided by two sprockets such as 14 situated in the vicinity of the entrance and exit, and between them by stringers such as 15 upon which the rollers 13*a* of the chains roll (FIG. 5).

The two chains 13 situated opposite one another thus form a conveyor having two superimposed horizontal sections, a descending section at the level of the sprockets 14 at the entrance and a rising section at the level of the sprockets at the exit.

Between the said chains there is articulated a plurality of crossbars such as 16. These bars of rectangular section with rounded edges are articulated like swings as illustrated in detail in FIG. 5, so as always to keep the same orientation in space whatever the section along which they are placed.

In the example represented in FIG. 5, each bar is carried at each end by the chains 13 through the interposition of suspension feet 17 and pins 18 seated in the hollow links of the chains 13.

Figure 6:
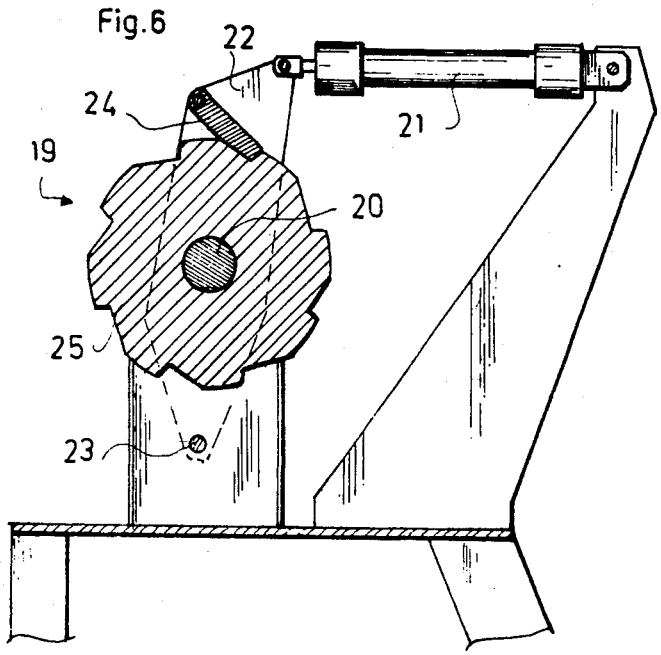
Figure 7:
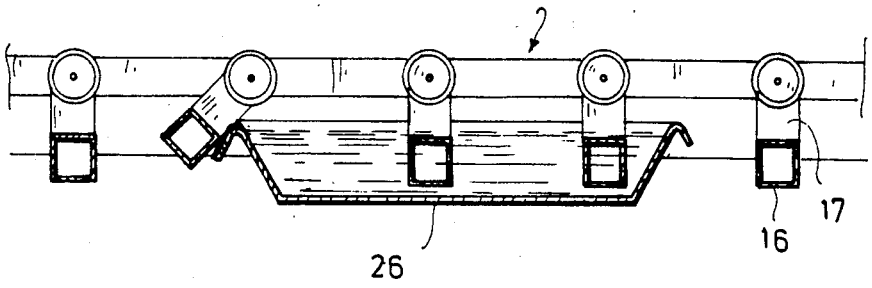

The chains 13 are driven in a sequential motion by driving means 19 which are shown diagrammatically in FIG. 6. In the example these means are situated at the exit end of the tunnel and comprise two synchronized hydraulic systems mounted on opposite sides of the tunnel outside it in the vicinity of its sides. These systems are suitable for driving in sequential rotation the cross-shaft 20 which carries the two sprockets 14 for guidance of the chains from the exit end. (The driving of the shaft situated at the exit is preferable but of course it is equally possible to provide hydraulic driving systems at the entrance end).

Each hydraulic system comprises a hydraulic jack 21 the body of which is hinged onto a fixed support, and the moving rod onto cheeks 22 hinged round a spindle 23. These cheeks 22 carry a pawl 24 which is arranged for cooperating with a ratchet wheel 25 mounted on the shaft 20 and locked in rotation to it.

The hydraulic jacks 21 situated on each side of the tunnel are driven by a hydraulic plant and equipped with synchronization which maintains their synchronous operation; control means of conventional type enable the travel of the jacks to be regulated so as to be able to adjust the average speed of the chains and the duration of the times at standstill.

Such hydraulic means are perfectly adapted to the driving of the chains 13 and their bars 16 because of the very high torque which they can develop whilst profiting from great structural simplicty (simple and not very costly mechanical means, with a hydraulic plant of usual type).

Furthermore the tunnel 12 contains at least one washing tank 26 which is arranged at the level of the horizontal return section of the conveyor (in the example, located above the forwards section). This tank 26 is endowed with water inlet and outlet pipework enabling a circulation of water in it to be ensured. It is arranged so that the crossbars 16 dip into it during the course of their travel along the said return section.

It is to be observed that when they reach the edges of the tank the bars 16 mounted like swings pivot upwards upon contact with the said edges in order then either to plunge into the tank or to be drawn out of it; the edges of the tank have a suitable shape for favouring the passage of the bars without jamming.

In addition the tunnel 12 is equipped with a number of rows of steam injectors such as 27, each of which extends transversely across the lower portion of the said tunnel and enables the atmosphere inside it to be saturated with moisture and the temperature of it to be adjusted accurately. These rows of injectors are distributed in several zones along the tunnel; one row 27 is situated in the vicinity of the entrance to the tunnel, its cross-section being greater than that of the other rows so as to be able to inject an amount of steam suited to generating the heating of the skins up to a temperature of from 25° to 30° C. The other rows of injectors are distributed with suitable deliveries as a function of their position so as to keep the skins at this temperature.

Means of distribution of delivery (shown symbolically by valves such as 28) enable the rows to be fed with steam at suitable deliveries.

Again, the tunnel 12 is endowed with suction means 29 and 30 the mouths of which are in the vicinity of the entrance and exit of the tunnel in order at this level to suck away the vapour with a view to reducing the losses towards the outside through the said entrance and exit. These means consist of hoods situated above the entrance and exit and of suction ducts enabling recycling of the vapour drawn in.

Figure 8A:
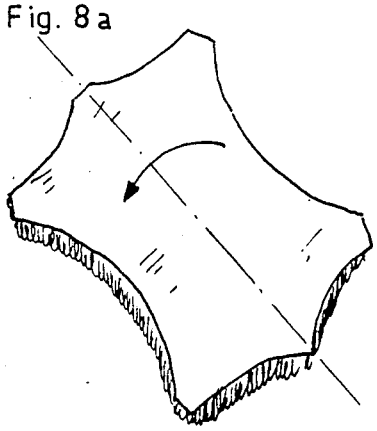
FIGS. 8*a*, 8*b* and 8*c* are diagrammatic views illustrating the putting in place of a skin in the sweating-tunnel.
Figure 8B:
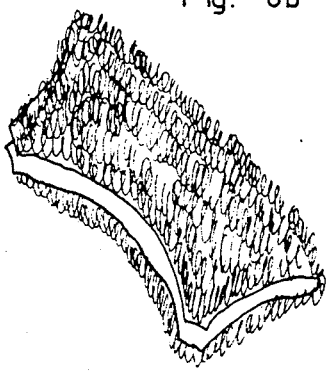
Figure 8C:
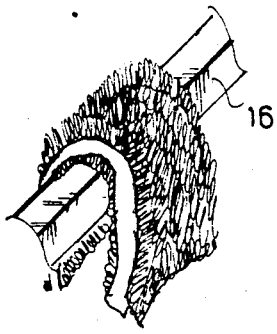

At the entrance to the tunnel 12 each skin is arranged individually on a crossbar 16 after being folded in two upon itself. The FIGS. 8*a*, 8*b*, 8*c* illustrate this operation: at the outlet from the limer 11 each skin is folded by an operator along a line of fold located along the spine of the skin so that the flesh side is situated inside and the hair side outside (FIGS. 8*a* and 8*b*); each skin is then hung astride one bar 16. The length of these bars may be of the order of 4.2 m so as to enable the putting in place of 8 skins close to one another.

By way of indication, the values of the essential parameters of the tunnel described above are as follows:

Total number of crossbars: of the order of 250 to 300;

Spacing between bars: about 300 mm;

Advance of the sequential motion by steps equal to the spacing between bars;

Duration of periods at standstill: between 30" and 60";

Time taken to cover one step: between 30" and 60".

These values enable the operators without difficulty to load and unload the skins at the level of the descending and rising sections of the conveyor; the skins are travelling in the tunnel 12 for a time of the order of 3 hours which may be regulated as needed by adjusting the characteristics of the sequential motion.

Figure 3C:
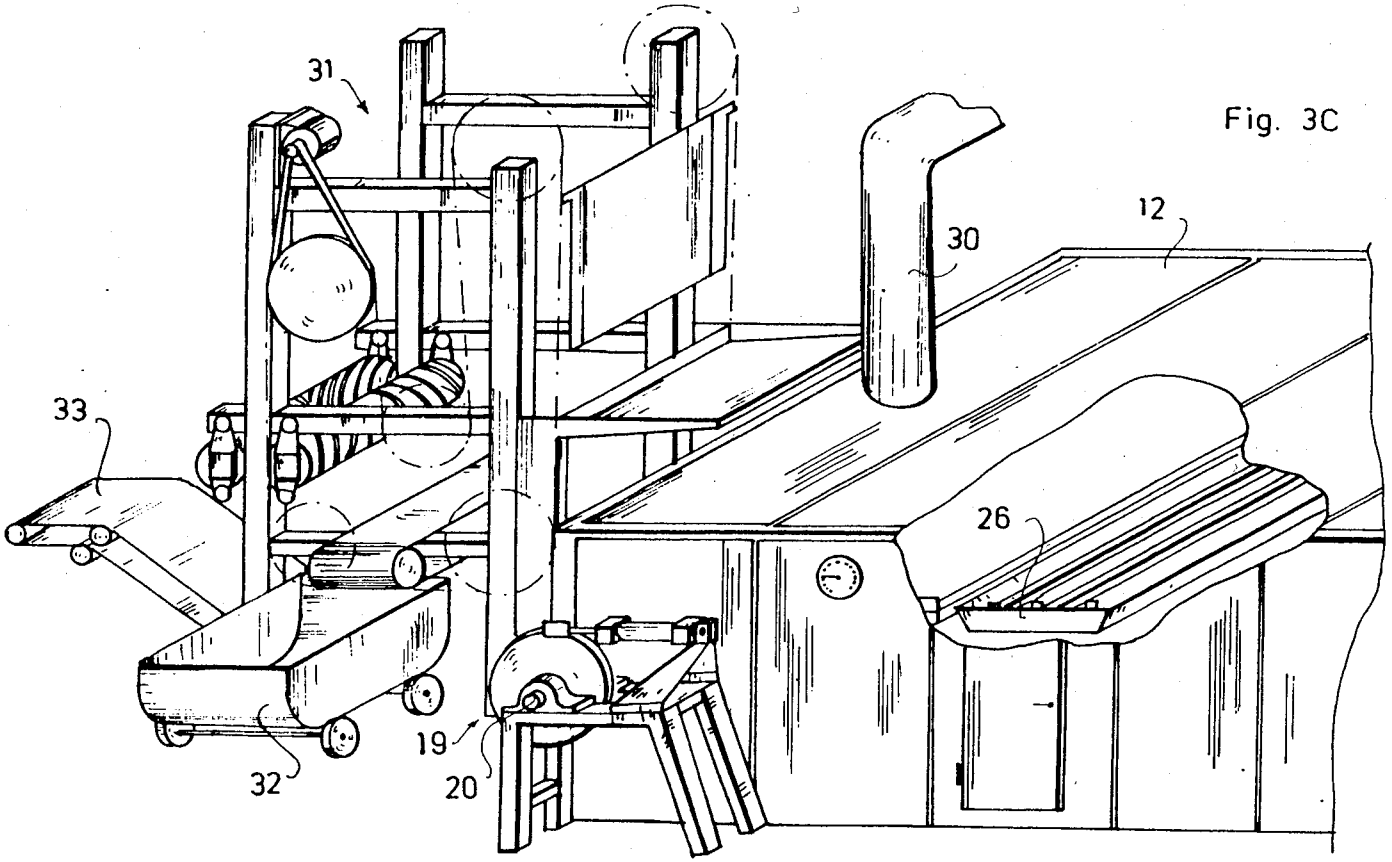
FIG. 3C is a diagrammatic figure of section C of the sequence T.

At the exit from the tunnel 12 (FIG. 3C) the skins are subjected to a wool-stripping operation upon a wool-stripping machine 31 of traditional type, which separates the wool from them. It has been possible to confirm experimentally that this work is easy to perform without risk of damage to the skins, taking into account the operations of previous preparation.

The pelts ready for returning to tawery, are discharged in trucks 32 whilst the wool is routed towards the rinsing on a conveyor belt 33.

Figure 3D:
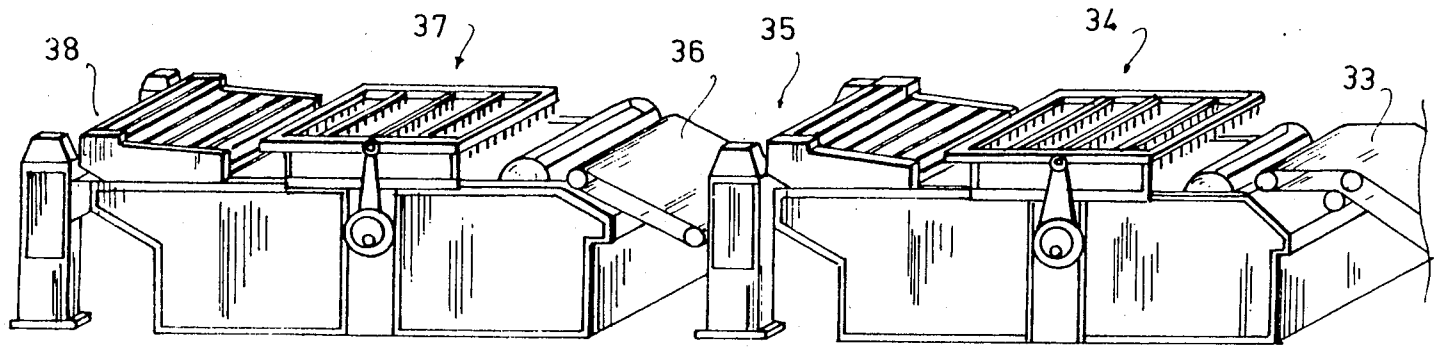
FIG. 3D is a diagrammatic figure of section D of the said sequence T.
Figure 4:
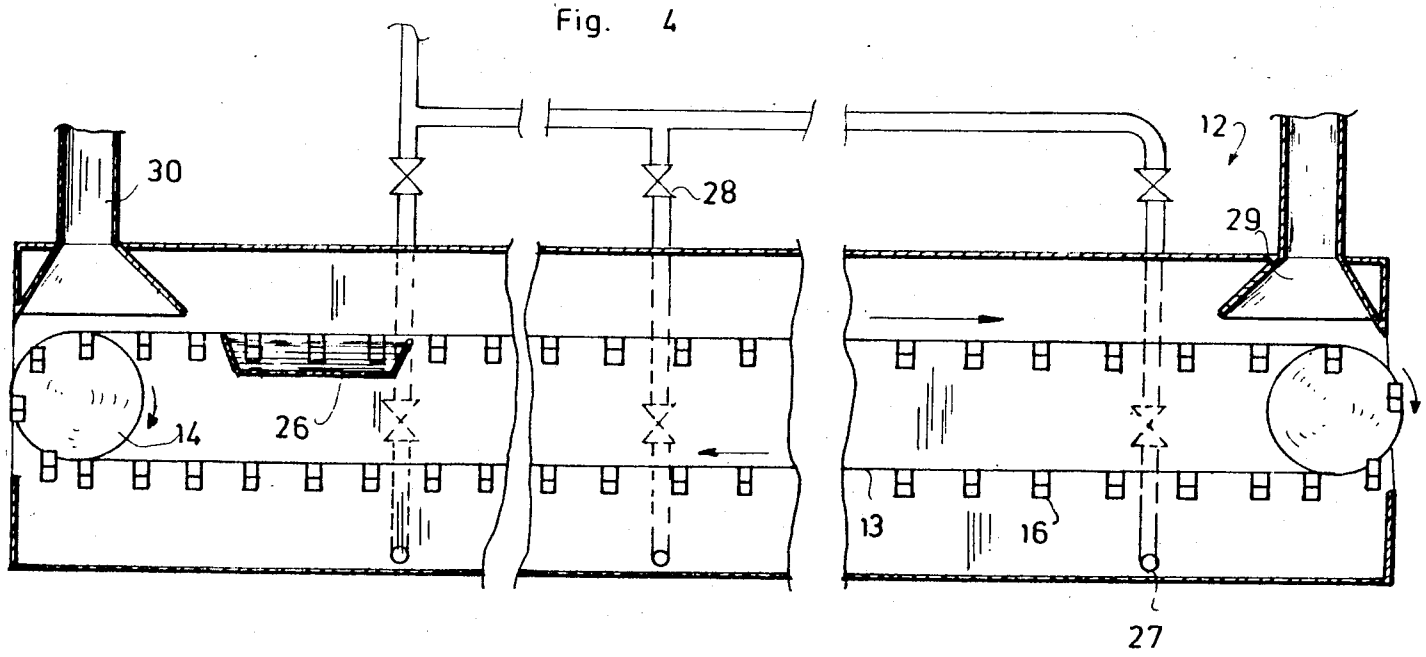
FIG. 4 is a diagrammatic section of one of the units of the treatment sequence (tunnel)

The wool is introduced into a first rinsing-tank 34 of a type known in itself where it undergoes rinsing in raw water (FIG. 3D).

After wringing by means of a wringer press 35 it is introduced by a conveyor belt 36 into a second rinsing-tank 37 containing a waterbath to which oxygenated water has been added, in a concentration which may lie between 4 and 20 g of oxygenated water per liter of water.

After wringing in a press 38 the wool which is in a good state without any trace of sulphide, may be routed towards the traditional subsequent operations of treatment.

It is to be observed that the units which are liable to be in contact with the sulphide solution are produced from anti-corrosive material such as stainless steel (tunnel and internal members, rinsing-tanks). Of course the invention is not restricted to the terms of the foregoing description but comprises any variant upon them.

We claim:

1. A method for treating sheepskins or the like for separating wool therefrom comprising sequentially (a) arranging said skins in a stack such that the sheepskins in the stack are vertically oriented or inclined with respect to the horizontal and soaking the thus oriented skins in a water bath, (b) subjecting the hair side of said skins to a picking operation for removing impurities therefrom, (c) subjecting the flesh side of said skins to a fleshing operation for removing fragments of flesh and fat therefrom, (d) impregnating the flesh side of said skins with an aqueous sulphide solution at a concentration of about 100 to 300 g/l, (e) supporting said skins in spaced relationship from one another in a moisture saturated atmosphere at a temperature of about 20° C. to 35° C. for a period of 2 to 5 hours, (f) subjecting said skins to a wool-stripping operation for removing wool therefrom, and (g) rinsing the removed wool for removing residual sulphide therefrom.

2. A method for treating sheepskins as in claim 1 and including arranging said skins by stacking said skins horizontally in a receptacle and causing said receptacle to pivot about a horizontal axis, placing said receptacle in a soaking tank containing water, and periodically renewing the water therein.

3. A method for treating sheepskins as in claim 2 and wherein said receptacles have a generally rectangular parallelepiped shape, and pivoting said receptacles through 90° so that said skins are vertically disposed.

4. A method for treating sheepskins as in claim 2 and including carrying out said soaking step for approximately 24 hours and renewing the water 2 to 4 times during said soaking.

5. A method for treating sheepskins as in claim 1 and including carrying out said impregnating using an aqueous solution of sodium sulphide of a concentration of about 200 g/l.

6. A method for treating sheepskins as in claim 1 and including spraying the flesh side of said skins with said sulphide solution in the form of fine drops.

7. A method for treating sheepskins as in claim 1 and including carrying out step e) by separately conveying said skins into a tunnel containing a saturated atmosphere at a temperature of 25° C. to 30° C., and causing said skins to pass through said tunnel from an entrance to an exit.

8. A method for treating sheepskins as in claim 7 and wherein said conveying step comprises folding said skins in half with their flesh sides in, suspending said folded skins from crossbars, driving said crossbars in a sequential motion of stops and translation, and removing said skins from said crossbars at said exit.

9. A method for treating sheepskins as in claim 8 and including providing a plurality of said crossbars on a horizontal continuous chain conveyor, hanging said skins on said crossbars at one end of said conveyor and removing said skins at the other end of said conveyor.

10. A method for treating sheepskins as in claim 7 and including injecting steam into said tunnel for maintaining said temperature.

11. A method for treating sheepskins as in claim 1 and including carrying out said rinsing step in a rinsing tank containing oxygenated water.

12. A method for treating sheepskins as in claim 11 and wherein said rinsing tank contains water having 4 to 20 g/l of oxygen.

* * * * *